United States Patent [19]

Castiglioni et al.

[11] 4,437,513

[45] Mar. 20, 1984

[54] HEAT RECOVERY APPARATUS

[76] Inventors: Joseph Castiglioni, 80 Stavola Rd.; Paul Rosenthal, 143 Woodgate Rd., both of Middletown, N.J. 07748

[21] Appl. No.: 341,139

[22] Filed: Jan. 20, 1982

Related U.S. Application Data

[63] Continuation of Ser. No. 911,975, Jun. 2, 1978, abandoned.

[51] Int. Cl.[3] ..... F28D 5/00; F28F 1/42

[52] U.S. Cl. ..... 165/154; 165/DIG. 2

[58] Field of Search ..... 165/39, 154, 155, 121, 165/122, 183, 174, 184, DIG. 2; 122/20 B; 237/20 B

[56] References Cited

U.S. PATENT DOCUMENTS

| | | | |
|---|---|---|---|
| 830,248 | 9/1906 | Orth | 165/154 |
| 2,059,992 | 11/1936 | Gould | 165/154 |
| 2,118,060 | 5/1938 | Stone et al. | 165/184 |
| 2,468,909 | 5/1949 | Yeagher et al. | 165/39 |
| 3,612,174 | 10/1971 | Schaan et al. | 165/154 |
| 4,013,122 | 3/1977 | Long | 165/154 |

FOREIGN PATENT DOCUMENTS

| | | | |
|---|---|---|---|
| 333947 | 1/1936 | Italy | 165/184 |
| 5788 | 9/1892 | Switzerland | 165/154 |

*Primary Examiner*—William R. Cline
*Assistant Examiner*—Theophil W. Streule, Jr.
*Attorney, Agent, or Firm*—Robert L. Stone

[57] ABSTRACT

Apparatus for recovering heat comprising an encapsulating outer wrapping having near opposite ends an air discharge opening and an opening adapted to receive an air intake blowing device; an inner corrugated galvanized sheet metal flue core; and two semi-circular baffles mounted in valleys of the inner core corrugations.

8 Claims, 5 Drawing Figures

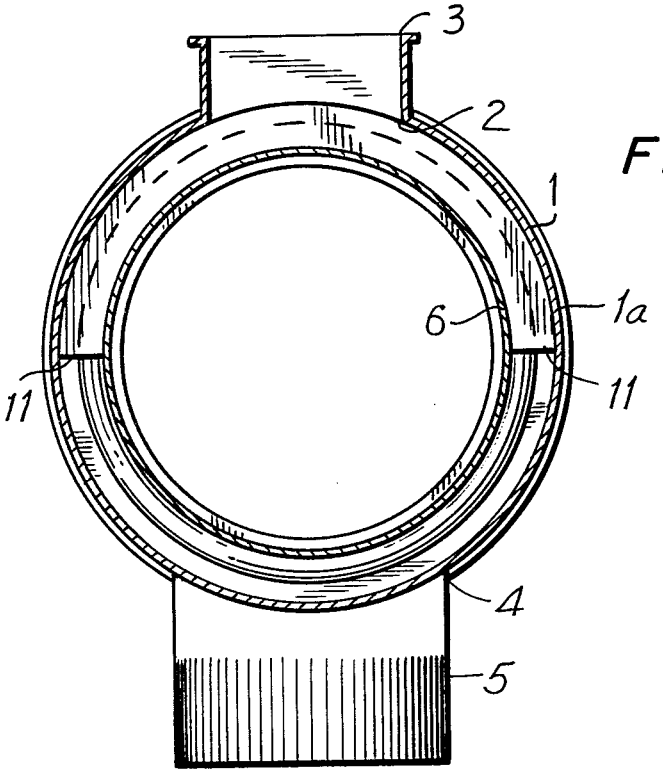
FIG. 3
FIG. 4
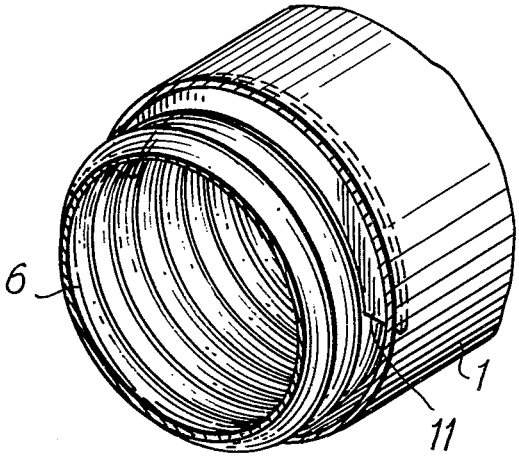
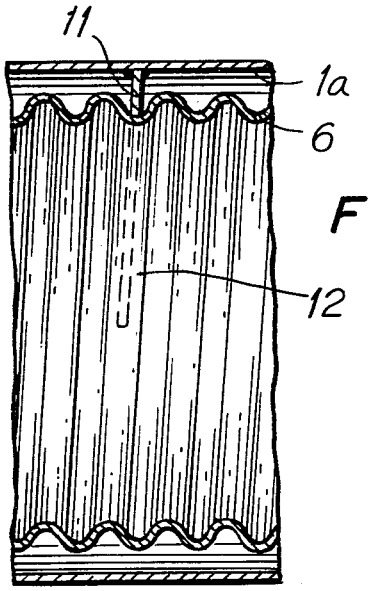
FIG. 5

HEAT RECOVERY APPARATUS

This is a continuation of application Ser. No. 911,975 filed on June 2, 1978, now abandoned.

This invention relates to an apparatus for recovering heat which is particularly suitable for use in the heating systems of private homes, apartment buildings and commercial establishments.

In recent times the need to conserve energy by reducing its consumption has been recognized as vital to the world's population. Yet heating systems in normal use in residence and business buildings emit much energy as heat which is wasted without providing comfort to the consumer.

It is an advantage of this invention that an apparatus is provided which permits highly effective heat-exchange retention. It is a further advantage of this invention that the amount of heat energy required to heat a confined space such as a room or even a building is greatly reduced. Other advantages of this invention will be apparent from consideration of the following specification.

In accordance with certain of its aspects, this invention relates to a heat recovery apparatus comprising (a) an encapsulating galvanized outer wrapping having at its substantially opposite ends, 180° F. apart, an air discharge opening and an opening adapted to receive a air supply blowing device; (b) an inner corrugated galvinized sheet metal flue core wherein the corrugated section is encapsulated within said outer wrapping, said inner core having non-corrugated end sections protruding beyond each end of said encapsulating outer wrapping, said ends havings axial openings adapted to fit into a combustion discharge system, wherein the corrugations of said inner core are free from direct contact with the inside surface of said outer wrapping; and (c) an even number plurality of semicircular baffles mounted in valleys of the corrugations of said inner core, each about equidistant from each other along the axial length of the corrugations, each being on an opposite side from the next adjacent baffle, the peaks of said baffles being in contact with the inner surface of said outer wrapping and substantially parallel to the openings in said outer wrapping.

In the past heat exchange devices have been prepared using torus-shaped baffles and with a corrugated inner core. Such devices, however, do not nearly approach the efficiency of the apparatus of the present invention. For instance, U.S. Pat. No. 2,468,909 to Yeager describes the use of torus baffles in conjunction with a cylindrical flue section within a casing. This device, however, lacks corrugations and cannot provide sufficient surface area to maximize heat transfer surface contact over its axial core length. Further, U.S. Pat. No. 2,913,009 to Kuthe describes heat exchange tubing in which the inner core is corrugated. However, the crests of the corrugations must be in full and continuous surface-to-surface contact with the radial inner surface of the outer tube. This contact would limit the efficiency of possible heat transfer surface area provided by the corrugations. Indeed, this patent does not even provide for forcing cold air into the corrugated valleys. Moreover, even if torus semi-circular baffles were to be provided to the device of the patent to Kuthe, heat flow would still be restricted due to the contact of the corrugation crests with the outer tube.

The present invention can be more fully appreciated with regard to the accompanying drawings.

FIG. 1 is a perspective view of an apparatus in accordance with the invention.

FIG. 2 is a side elevation section view along 2—2 of FIG. 1 of the outer core and the inner core including circumferential corrugations and ends. In this Figure encapsulation is attained with closures at the ends of the outer wrapping. Mounted baffles are shown in the corrugated area. Further, the direction of air flow is indicated.

FIG. 3 is a face elevation section view of the apparatus from 3—3 of FIG. 2.

FIG. 4 is a side perspective view including a baffle showing its positioning between the corrugation and the outer wrapping.

FIG. 5 is a side elevation view of a section of a modification of the apparatus of the invention in which the corrugations are helical or spiral.

The invention is specifically illustrated with further reference to the drawings.

Figure 1:
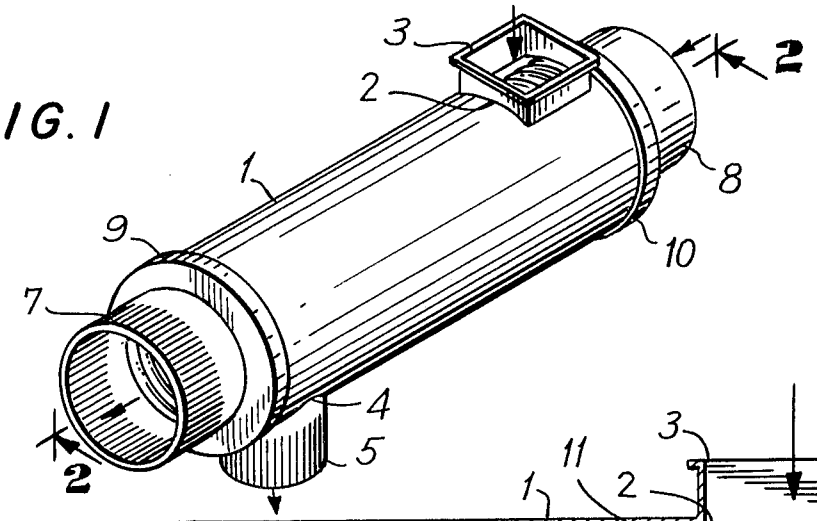

In FIG. 1, the outer wrapping 1, of galvanized sheet metal includes near one end an air intake hole 2 having thereon a flange 3 adapted to receive an electric blower motor, such as a fan. The blower motor is not depicted in the drawing. It is typically thermostatically controlled (e.g., between about 200°-800° F.). Near the opposite end of the outer wrapping 1, 180° F. from the air intake hole 2, there is a hole fitted with a section of galvanized flue pipe 5 which is the air discharge. The air intake hole 2 is shaped to receive a similarly shaped flange and blower motor. Typically it is rectangular or source although it could have other suitable shapes. Its area is approximately the same as the area of air discharge hole, e.g., about 8-30 $in^2$.

The outer wrapping 1 covers a galvanized corrugated inner core, leaving exposed a portion of non-corrugated ends thereof 7 and 8 of the inner core. Preferably, for optimum minimization of flue gas escape, end 7 is crimped to assist fitting it inside in an adjoining flue section (not shown). It is preferred that the crimped end 7 be the end away from the combustion source, such as a gas or oil burner. Galvanized closure collars 9 and 10 are fitted over the end sleeves 7 and 8 around the ends of the outer core 1, to effect encapsulation. Alternatively, the outer wrapper could be fabricated with integral turned ends to encapsulate the inner core.

Air flow direction is indicated in FIG. 1 by arrows entering and exiting the apparatus at holes 2 and 4.

If a thermostat (not shown) is employed, it would typically penetrate through the inner core at end 8, the end closest to the combustion source. The apparatus does not require a thermostat, particularly if the fan motor is connected in series with the existing furnace blower motor circuit.

Figure 2:
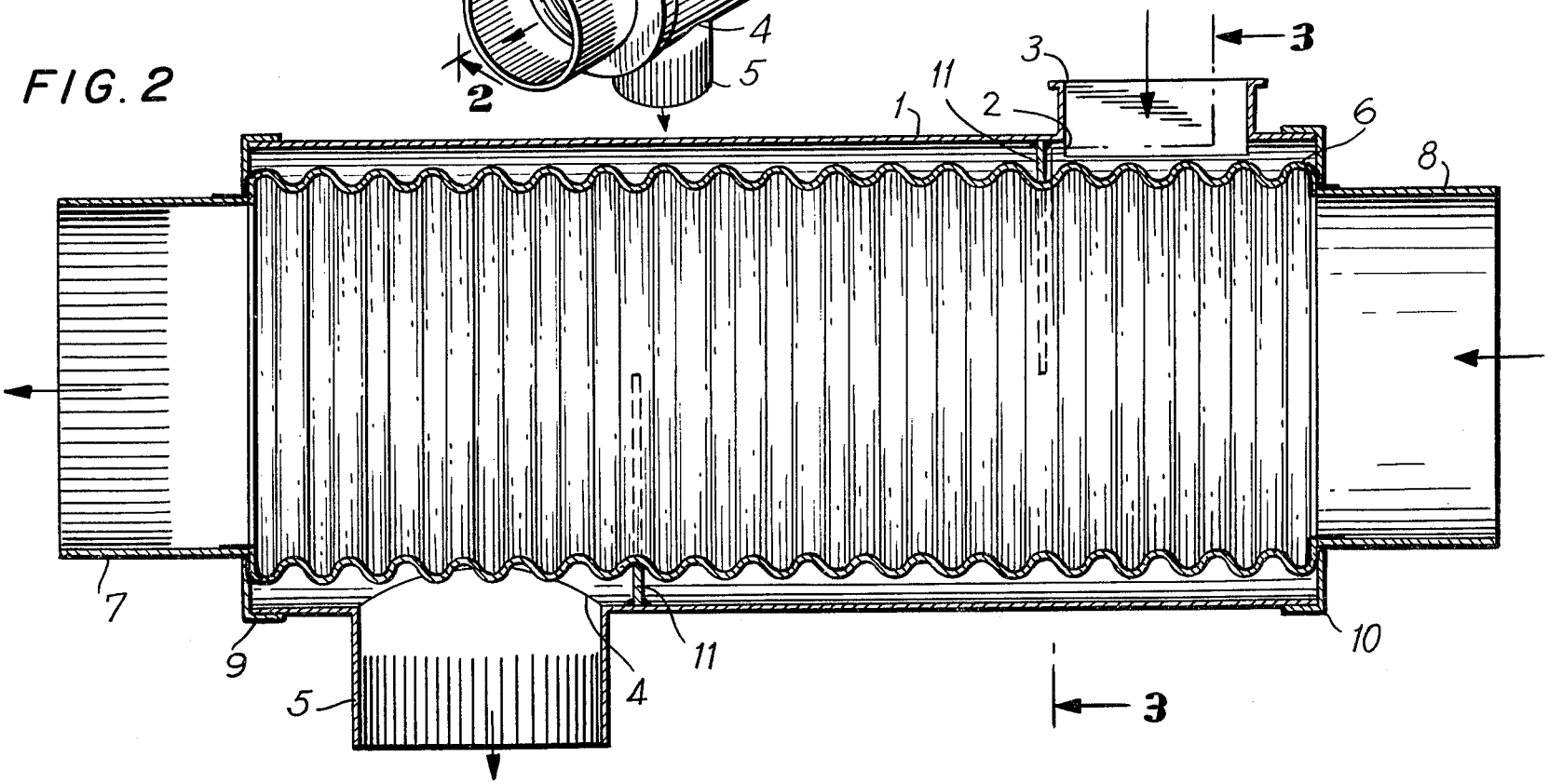

In FIG. 2, the outer wrapping 1, includes air intake hole 2 with flange 3 thereon and air discharge hole 4 with flue pipe 5 fitted therein, as described in FIG. 1. The corrugated portion of the inner core 6 is shown within the outer wrapping 1. The inner core further includes ends 7 and 8. The ends of the outer wrapping 1 are covered by collars 9 and 10 which are fitted around ends 7 and 8. The corrugated portion of the inner core 6 is depicted in FIG. 2 as circumferential or annular rings.

The diameter of the corrugated portion of the inner core 6 to the peaks of the corrugations is smaller than the inside diameter of the outer wrapping 1, typically by about 0.5 to 1.5 inches, preferably about 0.75 inches, leaving room for air flow over the surface of the corrugations. The direction of air flow in indicated by arrows in FIG. 2 entering at intake hole 2 and exiting at discharge hole 5. Within the apparatus, the air is directed over the entire surface of the corrugations by baffles 11 which are positioned in contact with corrugation valleys, 180° F. from each other. The baffles contact the inner surface of the outer wrapping 1. Depending on the size of the apparatus, an even number (two or more) baffles are used, preferably two to four and most preferably 2 in FIG. 2, two baffles are shown. One is positioned near the air intake hole 2 and the other near the air discharge hole 4. Typically each is about one-third of the distance from the nearest end of the corrguations 6.

In FIG. 3, the outer wrapping 1 is shown including air intake hole 2 with flange 3 thereon and air discharge hole 4 with flue section 5 therein. The corrugated inner core 6 is within the outer wrapping 1 and baffles 11 are shown extending from the corrugations 6 to the inner surface 1*a* of the outer wrapping 1.

FIG. 4 depicts the outer wrapping 1, the inner core 6 with circular corrugations 6 and a baffle 11 extending from a valley of corrugation 6 to the inner surface of the outer wrapping 1.

FIG. 5 depicts a modification of the invention in which a helical or spiral corrugated inner core 12 is present. Semicircular baffle 11 extends from a valley of a corrugation 12 to the inner surface 1*a* of the outer wrapping 1.

The efficiency of the present invention can be illustrated by the following experiment.

The apparatus of the present invention is installed by replacing a flue section at the discharge pipe of a gas furnace. A 150 CFM fan is used as the blower motor into the opening in the outer wrapping adapted to receive such a blowing device (for instance, with a mounting flange). The fan is controlled to trigger on at 200° F. The combustion gas temperature at entry 8, FIG. 2 into the corrugated core is 360° F. The fan blows the air at an ambient temperature of 48° F. over the inner core including around the corrugations with directional flow influenced by two baffles. At the flue discharge end 7, FIG. 2 the temperature is 310° F. and the air discharges into the room of 48° F., the air discharge temperature is 96° F. Thus, the device efficiently introduces an additional 48° F. into the ambient surroundings.

If desired, rather than using the recovered heat to directly heat a room or building, it may be rechanneled into the combustion source, to increase the thermal efficiency of the furnace.

We claim:

1. A combustion discharge system wherein: A heat recovery apparatus for flue gas is connected at an end section thereof to a gas furnace at the discharge pipe of the gas furnace and is connected at the opposite end section thereof to a section of flue apparatus, said heat recovery apparatus comprising:

(a) An encapsulating galvanized outer wrapping having (i) an opening which receives an air supply blowing device near the end section connected to the discharge pipe of the gas furnace and (ii) an air discharge opening 180° apart from said opening which receives the air supply blowing device and near the opposite end section connected to the section of flue apparatus;

(b) An inner corrugated galvanized sheet metal flue core wherein (i) the corrugated section of said flue core is encapsulated with means to effect closure with said outer wrapping and said flue core which is substantially free from direct contact along substantially its entire longitudinal extent with the inside surface of said outer wrapping and (ii) said inner core has non-corrugated end sections protruding beyond each end of said encapsulating outer wrapping, one of said non-corrugated end sections being said end section connected to the discharge pipe of the gas furnace and the other non-corrugated end section being said end section connected to the section of flue apparatus, thereby fitting said heat recovery apparatus into said combustion discharge system; and (c) at least a pair of semicircular baffles mounted in valleys of the corrugations of said inner core, each spaced one from the other along the axial length of the corrugations and each being on the opposite side from one another, the peaks of said baffles being in contact with the inner surface of said outer wrapping and substantially parallel to the openings in said outer wrapping to thereby permit unidirectional flow of air over the entire corrugated surface, said at least one pair of baffles being respectively positioned near the opening which receives the air supply blowing device and the air discharge opening.

2. The combustion discharge system claimed in claim 1 wherein the corrugations of said inner corrugated galvanized sheet metal flue core are circumferential.

3. The combustion discharge system claimed in claim 1 wherein the corrugations of said inner corrugated galvanized sheet metal flue core are helical.

4. The combustion discharge system claimed in claim 1 wherein there is a space of about 0.5 to 1.5 inches from the peaks of said corrugations to the inside surface of said outer wrapping.

5. The combustion discharge system claimed in claim 4 wherein said space is about 0.75 inches.

6. The combustion discharge system claimed in claim 1 wherein one pair of semi-circular baffles are employed.

7. The combustion discharge system claimed in claim 1 wherein said means comprise closure collars disposed over the ends of said outer wrapping to encapsulate said inner core.

8. The combustion discharge system claimed in claim 1 wherein the end section away from the discharge pipe of the gas furnace which is connected to said section of flue apparatus is crimped.

* * * * *